United States Patent [19]

Thornburgh

[11] 4,069,798

[45] Jan. 24, 1978

[54] PRESSURE TRANSDUCER AND EXHAUST GAS RECIRCULATION CONTROL VALVE USING SAME

[75] Inventor: William F. Thornburgh, Rochester, Mich.

[73] Assignee: General Motors Corporation, Detroit, Mich.

[21] Appl. No.: 745,128

[22] Filed: Nov. 26, 1976

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,756,210 | 9/1973 | Kuehl | 123/119 A |
| 3,783,848 | 1/1974 | Ranft et al. | 123/119 A |
| 3,799,131 | 3/1974 | Bolton | 123/119 A |
| 3,834,366 | 9/1974 | Kingsbury | 123/119 A |
| 3,880,129 | 4/1975 | Hollis, Jr. | 123/119 A |
| 3,926,161 | 12/1975 | Wertheimer | 123/119 A |
| 3,982,515 | 9/1976 | Bradshaw | 123/119 A |
| 3,996,905 | 12/1976 | Dawson | 123/119 A |

*Primary Examiner*—Charles J. Myhre
*Assistant Examiner*—David D. Reynolds
*Attorney, Agent, or Firm*—C. K. Veenstra

[57] ABSTRACT

In an internal combustion engine exhaust gas recirculation control valve assembly having a transducer which converts engine exhaust pressure to a controlled vacuum signal and having a valve pintle positioned in response to the controlled vacuum signal to control the flow of recirculated exhaust gases, an orifice member opens in response to high exhaust pressure to admit air to the transducer and thereby decrease the vacuum signal causing the valve pintle to decrease recirculation of exhaust gases.

3 Claims, 2 Drawing Figures

PRESSURE TRANSDUCER AND EXHAUST GAS RECIRCULATION CONTROL VALVE USING SAME

Figure 1:
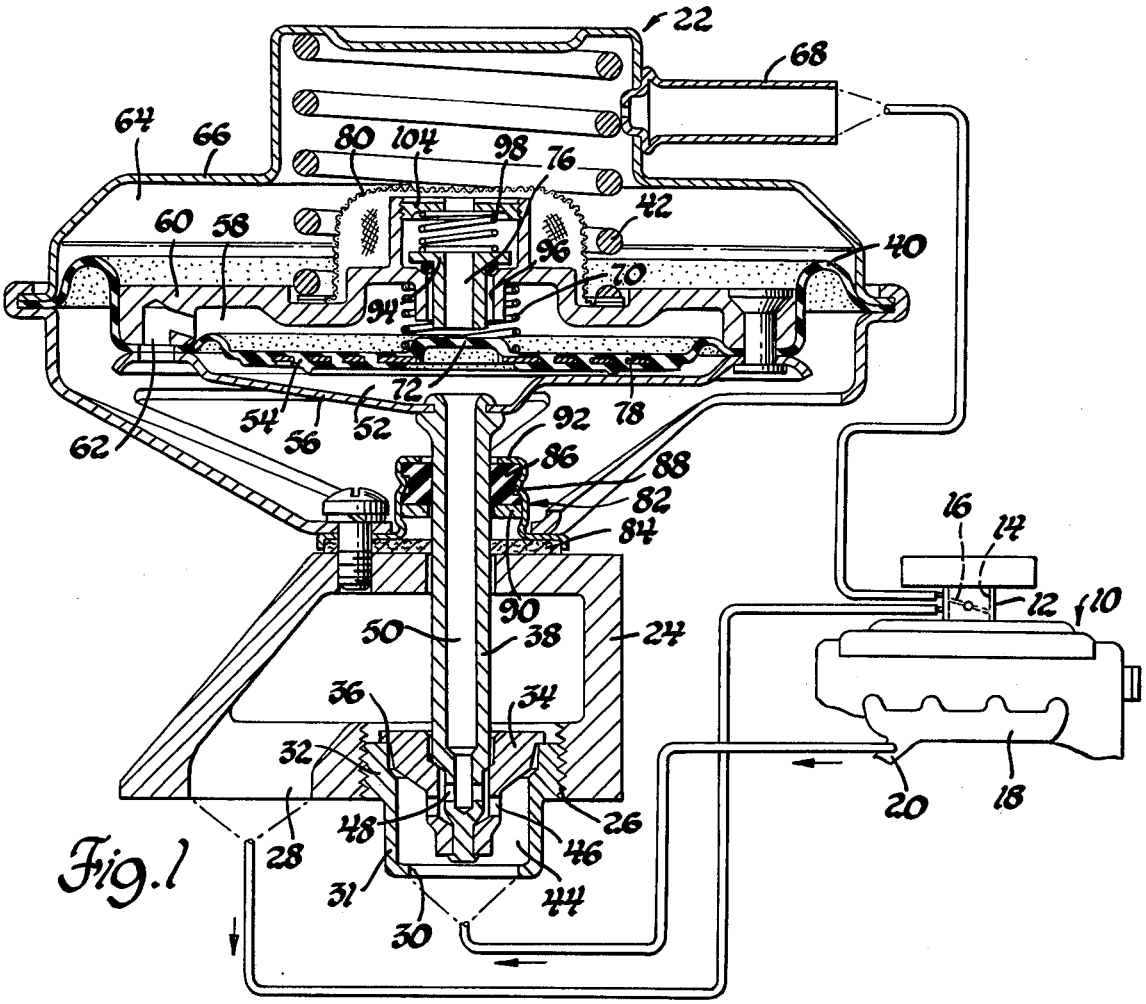

This invention relates to a novel pressure transducer and to a novel valve assembly using such a pressure transducer for controlling exhaust gas recirculation.

Recirculation of exhaust gases has been developed as a method for inhibiting formation of oxides of nitrogen during the combustion process in an internal combustion engine. In general, it is desired to recirculate the exhaust gases at a rate proportional to the rate at which combustion air flows into the engine, and valves responsive to induction passage vacuum or throttle position have been utilized for this purpose.

It also has been recognized that if exhaust gases were recirculated through an orifice into a region of substantially atmospheric pressure in the engine air induction system, variations in exhaust pressure would cause the exhaust gas recirculation rate to be proportional to the combustion air flow rate. However, such a system would require that the exhaust gases pass through at least a portion of the carburetor.

This invention provides a novel valve assembly utilizing exhaust pressure to recirculate exhaust gases at a rate proportional to air flow and in a manner which avoids recirculation of exhaust gases through the carburetor. In employing this invention, an exhaust gas recirculation passage is provided which extends from the engine exhaust passage to the engine air induction passage at a point downstream of the engine throttle. An orifice is provided in the recirculation passage, and a valve disposed downstream of the orifice is operated to create a zone of substantially constant pressure in the passage irrespective of the wide variations in exhaust pressure and induction passage vacuum. Recirculation of exhaust gases through the zone thus varies in proportion to induction air flow.

In some valve assemblies proposed for controlling exhaust gas recirculation in accordance with exhaust pressure, the diaphragm responsive to exhaust pressure has directly operated the valve pintle to control the flow of exhaust gases. In the design of such a valve assembly, certain limitations are encountered because the exhaust pressure is relatively low. In the valve assembly of this invention, on the other hand, the exhaust gas flow controlling valve pintle is not directly operated by an exhaust pressure responsive diaphragm; instead, the valve pintle is positioned by a main diaphragm operated by a controlled subatmospheric pressure signal, and a transducer including a pilot diaphragm and bleed valve responsive to exhaust pressure varies flow through an air bleed into a region of subatomspheric pressure to create the controlled pressure signal.

Valve assemblies of the foregoing description are set forth in U.S. Pat. Nos. 3,834,366 and 3,880,129. Those eariler valve assemblies sensed induction passage pressure through a port traversed by the throttle, thus sensing substantially atmospheric pressure during closed throttle idling conditions and subatmospheric manifold pressure during open throttle operation; the eariler valve assemblies accordingly restricted exhaust gas recirculation during closed throttle idling and during wide open throttle operation (when manifold pressure approaches atmospheric) in a desirable manner. Further, with the use of appropriate temperature responsive or other valves in the pressure line, the earlier valve assemblies could restrict exhaust gas recirculation under other operating conditions where so required.

However, in some applications it also may be desirable to restrict recirculation of exhaust gases during part throttle high speed operating conditions. While such a mode of control may be suggested in connection with the FIG. 9 embodiment of the valve assembly shown in U.S. Pat. No. 3,799,131, no appropriate structure has been available to provide such a mode of control in the valve assemblies which use an exhaust pressure transducer.

This invention provides a transducer for converting exhaust pressure to a controlled pressure, and an exhaust gas recirculation control valve assembly using that transducer, in which the controlled pressure is raised from subatmospheric to substantially atmospheric when the exhaust pressure exceeds a certain level. Accordingly, during part throttle high speed (and thus high exhaust pressure) engine operation, the transducer provides a substantially atmospheric controlled pressure signal and the exhaust gas recirculation control valve assembly restricts recirculation of exhaust gases.

The preferred embodiment of the transducer provided by this invention accomplishes the foregoing through a structure including an exhaust pressure responsive bleed valve which varies air flow through an air bleed into a region of subatmospheric pressure to create the controlled pressure signal and in which the air bleed is formed in an orifice member which is displaced from an orifice by the bleed valve in response to high exhaust pressure, thus permitting air at atmospheric pressure to enter the controlled pressure region and raise the region to substantially atmospheric pressure.

Figure 2:
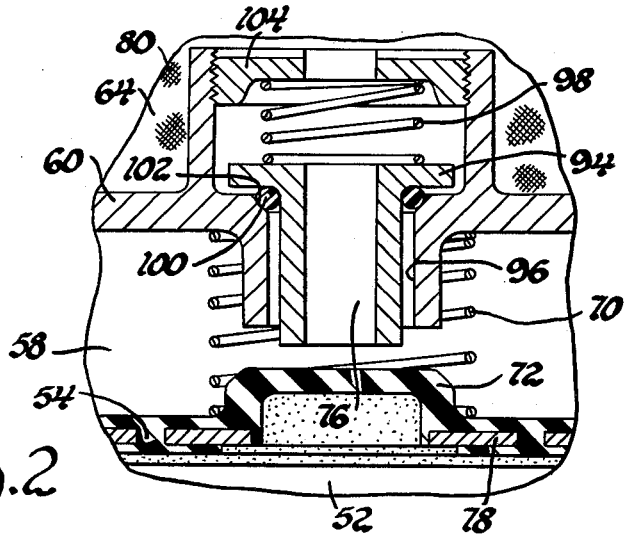

The details as well as other features and advantages of this invention are set forth in the remainder of the specification and are shown in the drawings, in which:

FIG. 1 is a sectional elevational view of an exhaust gas recirculation control valve assembly embodying this invention, together with a schematic illustration of its connections to an internal combustion engine; and FIG. 2 is an enlarged view of a portion of FIG. 1 showing the details of construction of the orifice member.

Referring first to FIG. 1, an internal combustion engine 10 has a carburetor 12 forming a poriton of an air induction passage 14. A throttle 16 is disposed in induction passage 14 to control air flow therethrough. Engine 10 also has an exhaust manifold 18 defining a portion of an exhaust passage 20 for exhaust gas flow from the engine.

An exhaust gas recirculation control valve assembly 22 comprises a valve body 24 havig an inlet 26 receiving exhaust gases from exhaust passage 20 and an outlet 28 discharging exhaust gases to induction passage 14 downstream of throttle 16. An orifice 30, disposed across inlet 26, is formed in an extension 31 of a valve seat member 32 which is threadedly secured in inlet 26 in a tamperproof location. A valve pintle 34 has a contour cooperating with the valve seat 36 to control the flow of exhaust gases recirculated from exhaust passage 20 to induction passage 14. Pintle 34 is secured on a hollow valve stem 38 carried by a pressure responsive diaphragm 40 and downwardly biased by a spring 42.

The pressure in the zone 44, defined between orifice 30 and valve seat 36, is applied through lateral openigs 46 and 48 in pintle 34 and stem 38, respectively, and through a longitudinal passage 50 formed in stem 38 to a control pressure chamber 52 defined between the central or pilot portion 54 of diaphragm 50 and a dished diaphragm backing member 56. A chamber 58, defined between central portion 54 of diaphragm 40 and another dished diaphragm backing member 60, is maintained at atmospheric pressure by a plurality of annularly spaced openings 62 extending through diaphragm 40 and backing members 54 and 60. The region 64, defined over diaphragm 40 and backing member 60 by a cover 66, forms a controlled pressure chamber subjected to the pressure in induction passage 14 adjacent throttle 16 by an orificed fitting 68.

In operation, as the control pressure in zone 44 and control pressure chamber 52 drops, central portion 54 of diaphragm 40 is pushed downwardly by a spring 70. A bleed valve member 72, formed as part of inner diaphragm portion 54, then is displaced from an air bleed 76 to admit air from atmospheric pressure chamber 58 to chamber 64. This increases the controlled pressure (or decreases the controlled vacuum signal) in chamber 64, and spring 42 displaces diaphragm 40, stem 38 and valve pintle 34 toward valve seat 36 to reduce recirculation of exhaust gases. Upon an increase in the control pressure in zone 44 and control pressure chamber 52, diaphragm portion 54 moves upwardly against the bias of spring 70 and valve member 72 reduces air flow through air bleed 76 into chamber 64. The resulting reduction in the controlled pressure in chamber 64 displaces diaphragm 40, stem 38, and valve pintle 34 upwardly from valve seat 36, thereby increasing recirculation of exhaust gases. In this manner, a constant pressure is maintained in control pressure zone 44 downstream from orifice 30.

The pressure created in the engine exhaust passage 20 is generally proportional to the square of the rate of combustion air flow through the engine induction passage 14, and the rate of flow of exhaust gases from exhaust passage 20 through orifice 30 into a zone 44 of substantially constant pressure is generally proportional to the square root of the exhaust pressure. Thus the rate at which exhaust gases are recirculated is generally proportional to the rate at which combustion air flows to the engine.

It will be noted that the central portion 54 of diaphragm 40 is molded about a stiffening plate 78 and thus does not require a separate backing plate. In addition, a screen 80 is disposed in chamber 64 over air bleed 76 and is retained against backing member 60 by spring 42 to prevent entry of foreign particles from atmospheric pressure chamber 58. Further, an insulator assembly 82 surrounds valve stem 38 and includes an asbestos insulator pad 84 to reduce heat transfer from valve body 24 and a valve stem seal 86 to preclude leakage about valve stem 38. Seal 86 is a blend of about 25% by weight of a polyester known by the trademark Ekonol and about 75% of a polytetrafluoroethylene such as that known by the trademark Teflon and has an annular groove 88 to permit thermal expansion. A supporting stainless steel washer 90 is disposed below seal 86 and retained by crimping the insulator assembly housing 92; housing 92 also may be crimped into groove 88 at several radially spaced locations to prevent seal rotation during manufacture.

It will be appreciated that, if desired, valves responsive to temperature and other engine or vehicle operating conditions may be disposed in the vacuum line between fitting 68 and induction passage 14 to control applicaton of vacuum to chamber 64 and thus to superimpose supplemental control on recirculation of exhaust gases.

It also will be appreciated that valve assembly 22 may be tailored to prevent recirculation of exhaust gases whenever the induction passage vacuum is very low, thus preventing any reduction in power due to charge dilution during heavily loaded operation. In addition, fitting 68 may receive the vacuum signal from a port located adjacent and traversed by the upstream edge of throttle 16, thus preventing recirculation of exhaust gases during closed throttle operation when the port senses the substantially atmospheric pressure upstream of throttle 16.

In some applications it also may be desirable to restrict recirculation of exhaust gases during part throttle high speed engine operation. During such conditions of operation, the high exhaust pressure in exhaust passage 20 increases the pressure in zone 44 and chamber 52, raising the central portion 54 of diaphragm 40 to engage bleed valve member 72 over and obstruct air bleed 76. However, the induction passage vacuum in chamber 64 during such conditions of operation is sufficient to overcome spring 42, and valve pintle 34 is momentarily lifted away from valve seat 36. Since complete opening of valve pintle 30 does not compensate for the increased exhaust pressure in zone 44 under these conditions of operation, the center portion of diaphragm 40 continues to push bleed valve member 72 against air bleed 76.

Air bleed 76 is formed in an orifice member 94 which is disposed in an orifice 96 formed in backing plate 60. When bleed valve member 72 is pushed upwardly during high exhaust pressure conditions of operation, it lifts orifice member 94 against the bias of a spring 98 and disengages an O-ring 100, included as part of member 94, from a seat 102 about orifice 96, thus allowing air to flow from chamber 58 through orifice 96 into chamber 64. The increased pressure in chamber 64 allows spring 42 to engage valve pintle 34 with seat 36 to restrict recirculation of exhaust gases.

When engine speed is reduced and the exhaust pressure drops, spring 70 moves bleed valve member 72 downwardly and spring 98 seats orifice member 94 in orifice 96, thus allowing normal operation.

Spring 98 is supported by a threaded spring seat 104 which may be turned to adjust the setting at which orifice member 94 is displaced in orifice 96.

The embodiments of the invention in which an exclusive property or privilege is claimed are defined as follows:

1. For use on an internal combustion engine having an induction passage for air flow to the engine, a throttle in said induction passage for controlling air flow therethrough, and an exhaust passage for exhaust gas flow from the engine: a pressure transducer for converting the variable pressure in said exhaust passage to variable vacuum signal, said transducer including a reciprocable pressure responsive diaphragm, said diaphragm having a valve member reciprocable therewith, a first housing member secured on one side of said diaphragm to form an exhaust pressure chamber therebetween, a second housing member secured on the other side of said diaphragm to form an atmospheric pressure chamber therebetween, said first housing member having means for subjecting said exhaust pressure chamber to the pressure in said exhaust passage, said second housing member having means for subjecting said atmospheric pressure chamber to atmospheric pressure, said second housing further having means defining a region outside said atmospheric pressure chamber adapted to be subjected to the vacuum in said induction passage downstream of said throttle, said second housing member also having an orifice opening from said atmospheric pressure chamber to said region, and wherein the improvement comprises an orifice member disposed in said orifice and biased into engagement therewith to obstruct flow through said orifice about said orifice member, said orifice member having an air bleed extending therethrough, said valve member being associated with said air bleed for varying air flow from said atmospheric pressure chamber into said region to thereby vary the pressure in said region in accordance with variations in the exhaust passage pressure, said valve member being adapted to disengage said orifice member from said orifice when said exhaust passage pressure exceeds a certain level to thereby permit air flow from said atmospheric pressure chamber through said orifice about said orifice member into said region.

2. An exhaust gas recirculation control valve assembly for use on an internal combusting engine having an induction passage for air flow to the engine, a throttle disposed in said induction passage for controlling air flow therethrough, and an exhaust passage for exhaust gas flow the engine, said control valve assembly comprising a valve body having an inlet for receiving exhaust gases from said exhaust passage, an outlet for discharging exhaust gases to said induction passage, a valve seat formed between said inlet and said outlet, and an orifice formed in said inlet and defining a control pressure zone between said orifice and said valve seat, a valve pintle associated with said valve seat for controlling flow of exhaust gases therethrough, and control means for positioning said valve pintle to maintain a substantially constant pressure in said control pressure zone, said control means including spring means biasing said valve pintle toward engagement with said valve seat, a pressure responsive member connected to said valve pintle, means defining a vacuum orifice through which said member is subjected to the pressure in said induction passage downstream of said throttle, means defining an orifice through which said member is subjected to atmospheric air, an orifice member disposed in said orifice and biased into engagement therewith to obstruct flow through said orifice about said orifice member, said orifice member having an air bleed extending therethrough, a bleed valve associated with said air bleed for controlling admission of air therethrough to vary the controlled pressure created by induction passage vacuum received through said vacuum orifice and atmospheric air received through said air bleed, pressure responsive means connected to said bleed valve and subjected to the pressure in said zone whereby upon an increase in pressure in said zone said pressure responsive means displaces said bleed valve to decrease admission of air through said air bleed and thereby decreases said controlled pressure to cause said pressure responsive member to overcome the bias of said spring means and displace said valve pintle from said valve seat and increase recirculation of exhaust gases, and second spring means biasing said bleed valve to permit increased admission of air through said air bleed whereby upon a decrease in pressure in said zone said second spring means displaces said bleed valve to increase admission of air through said air bleed and thereby increases said controlled pressure to permit said first spring means to displace said valve pintle toward said valve seat and decrease recirculation of exhaust gases, and wherein said valve member is adapted to disengage said orifice member from said orifice when the pressure in said zone exceeds a certain level to permit air flow from said atmospheric pressure chamber through said orifice about said orifice member and thereby increase said controlled pressure to permit said first spring means to displace said valve pintle toward said valve seat and decrease recirculation of exhaust gases.

3. An exhaust gas recirculation control valve assembly for use on an internal combustion engine having an induction passage for air flow to the engine, a throttle disposed in said induction passage for controlling air flow therethrough, and an exhaust passage for exhaust gas flow from the engine, said control valve assembly comprising a valve body having an inlet for receiving gases from said exhaust passage, an outlet for discharging exhaust gases to said inducton passage, a valve seat formed between said inlet and said outlet, and an orifice formed in said inlet and defining a control pressure zone between said orifice and said valve seat, a valve pintle associated with said valve seat for controlling flow of exhaust gases therethrough, and control means for positioning said valve pintle to maintain a substantially constant pressure in said control pressure zone, said control means including spring means biasing said valve pintle toward engagement with said valve seat, a hollow valve stem connected to said valve pintle and extending outwardly of said valve body, a pressure responsive assembly having a first diaphragm backing member secured to said valve stem, a diaphragm having a flexible inner portion defining a control pressure chamber with said backing member, said diaphragm further having a flexible annular outer portion extending radially outwardly from said backing member, and a second diaphragm backing member defining an atmospheric pressure chamber with said inner portion of said diaphragm, a cover member defining a vacuum chamber with said outer portion of said diaphragm and said backing member, said cover member having means for connecting said vacuum chamber to said induction passage downstream of said throttle, said inner portion of said diaphragm and said backing members having openings for admitting air to said atmospheric pressure chamber, said second backing member having an orifice for admitting air from said atmospheric pressure chamber to said vacuum chamber, an orifice member disposed in said orifice and biased into engagement therewith to obstruct flow through said orifice about said orifice member, said orifice member having an air bleed extending therethrough, a bleed valve connected to said inner portion of said diaphragm and associated with said air bleed for controlling admission of air to said vacuum chamber, said hollow stem defining a passage connecting said exhaust pressure chamber to said zone, whereby upon an increase in pressure in said zone said inner portion of said diaphragm displaces said bleed valve to decrease admission of air to said vacuum chamber through said air bleed and thereby decreases the pressure in said vacuum chamber to cause said pressure responsive member to overcome the bias of said spring means and displace said valve pintle from said valve seat and increase recirculation of exhaust gases, and second spring means biasing said bleed valve to permit increased admission of air to said vacuum chamber through said air bleed whereby upon a decrease in pressure in said zone said second spring means displaces said bleed valve to increase admission of air to said vacuum chamber through said bleed orifice and thereby increases the pressure in said vacuum chamber to permit said first spring means to displace said valve pintle toward said valve seat and decrease recirculation of exhaust gases, and wherein said valve member is adapted to disengage said orifice member from said orifice when the pressure in said zone exceeds a certain level to permit air flow from said atmospheric pressure chamber through said orifice about said orifice member and thereby increase said controlled pressure to permit said first spring means to displace said valve pintle toward said valve seat and decrease recirculation of exhaust gases.

* * * * *